United States Patent [19]

Appelgren

[11] Patent Number: 4,896,518

[45] Date of Patent: Jan. 30, 1990

[54] ACCESS PREVENTION DEVICE AND METHOD OF MANUFACTURE

[76] Inventor: Donald W. Appelgren, 523 South 16th St., LaPorte, Tex. 77571

[21] Appl. No.: 244,039

[22] Filed: Sep. 14, 1988

[51] Int. Cl.[4] ..... E05B 67/38

[52] U.S. Cl. ..... 70/54; 70/14; 70/55; 70/56

[58] Field of Search ..... 70/14, 18, 19, 57, 58, 70/54–56

[56] References Cited

U.S. PATENT DOCUMENTS

| | | | |
|---|---|---|---|
| 2,584,575 | 2/1952 | Goldwasser | 292/205 X |
| 3,736,016 | 5/1973 | Garvey et al. | 70/56 X |
| 3,916,654 | 11/1975 | Mudge, Jr. | 70/56 |
| 4,290,284 | 9/1981 | Nicksic | 70/227 X |
| 4,307,904 | 12/1981 | Daus | 70/56 X |
| 4,322,102 | 3/1082 | Lindblom | 70/56 X |
| 4,380,160 | 4/1983 | Hoffman | 70/14 |
| 4,407,146 | 10/1983 | Nielsen, Jr. | 70/18 X |
| 4,506,528 | 3/1985 | Eberly | 70/18 |
| 4,567,740 | 2/1986 | Kelly | 70/55 |
| 4,774,823 | 10/1988 | Callison | 70/57 X |
| 4,781,043 | 11/1988 | Loeffler | 70/417 X |

*Primary Examiner*—Robert L. Wolfe
*Assistant Examiner*—Suzanne L. Dino
*Attorney, Agent, or Firm*—J. Peppers

[57] ABSTRACT

An access prevention device having a rigid metal enclosure body made of metal plate and having a plurality of sides. A first elongated slot is formed linearly in a first wall and adapted to receive the shackle of a padlock inserted into a first end of the body. A second elongated slot is formed linearly in a second wall and adapted to receive the staple loop of a hasp interlinked with the shackle of the padlock. The device may be heat treated to resist being disabled. The padlock shackle encloses a portion of the first wall and the loop of the staple when it is locked into place. A protective skirt extends longitudinally between the ends of the body and forms the sides of the body. The protective skirt is adapted to protect the padlock shackle from access by external cutting devices.

4 Claims, 3 Drawing Sheets

ACCESS PREVENTION DEVICE AND METHOD OF MANUFACTURE

BACKGROUND OF THE INVENTION

This invention generally pertains to an access prevention and protective device which is interlinked with both the staple of a hasp and a shackle of a padlock, when the padlock shackle is locked, to protect the padlock and its shackle from damage or destruction by various cutting tools. Also disclosed is a preferred method of manufacturing the device.

There is a need for a simple and inexpensive device with no moving parts to prevent unauthorized access or entry into a compartment secured by a conventional padlock, or severance of property secured in place by means of such a padlock. The padlock and its shackle needs to be protected as well as the staple of the hasp being secured by the padlock.

As is well known there is a problem in boat yards, mobile home parks, personal goods storage facilities, and the like, where unauthorized persons break or destroy padlocks in order to get into or remove property which has been locked up. Although there are protective devices available for protecting padlocks against unauthorized removal, these devices are variously complicated, protect only the padlock shackle, and expensive.

Presently known prior art which shows such protective devices are U.S. Pat. Nos. 1,429,105; 2,541,638; 2,584,575; 3,916,654; 4,031,719; 4,033,155; 4,141,232; 4,322,102; 4,380,160; and 4,506,528.

OBJECTS OF THE INVENTION

A principal object of the present invention is to provide a simple integral protective device which will conveniently prevent access to the staple of a hasp and a padlock, including its shackle, from force applied externally of the device;

Another object of the present invention is to provide a method of manufacture of a padlock protective device which is simple and easy to perform in quantity production;

Another object of the present invention is to provide an access protective device wherein the hasp staple, the padlock shackle, and the protective device are all interlinked together in a simple manner as the lock shackle is engaged with the hasp staple.

SUMMARY OF THE INVENTION

The forgoing and other objects of the present invention are obtained by a padlock protective device having an enclosure body made of rigid metal plate having a plurality of sides, and its method of manufacture. A first elongated slot is formed linearly in a first wall and adapted to receive the shackle of a padlock inserted into a first side of the body. A second elongated slot is performed linearly in a second wall and adapted to receive the staple loop of a hasp interlinked with the shackle of the padlock and a portion of the first side of the body. A protective skirt extends longitudinally between the ends of the body and includes at least three sides of the body. The protective device is adapted to protect the padlock shackle and the staple from damage by external cutting devices.

DESCRIPTION OF A PREFERRED EMBODIMENT

Figure 1:
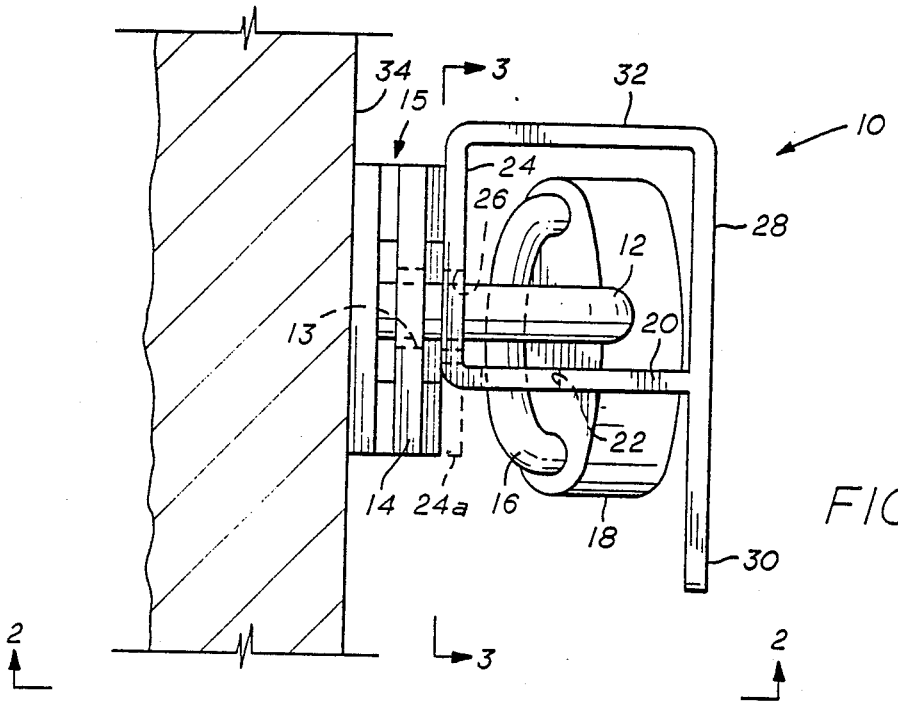
FIG. 1 is an end view of the lock protection device as engaged with a conventional padlock and hasp.

As variously seen in FIGS. 1–4, the protective device is incorporated into a body 10 which receives a hasp staple loop 12 of a hasp 15 which has passed through the slot 13 of a hasp strap 14 to be interlinked with the shackle 16 of a padlock 18.

The body 10 forms an enclosure which is generally rectangular in cross-section including a side 20 forming a shackle slot 22, a skirted shield side 24 forming a hasp staple slot 26, and a skirted shield side 28 forming a shield flange 30. As seen, a lock shackle loop is formed in side 20 between the slot 22 and the lower edge of side 20. The shield sides 24 and 28 are joined together by a skirted shield side 32 to complete the rectangular enclosure as shown. The side 20 extends part way along the skirts of the shields sides 24 and 28 such that the shackle 16 of the lock 18 may be inserted through the shackle slot 22 with the body of padlock 18 totally enclosed by the skirts of the shield sides 24, 28 and 32.

As noted, the body 10 is an integral body with all the sides 20, 24, 28 and 32 being joined as a unitary structure. The body 10 may be fabricated in different ways to provide the desired structure as shown. For example, the body 10 may be formed of ⅛ inch or 3/16 inch steel plate which has been bent as shown with the remaining seam welded together through a conventional process term known as progressive stamping.

The body 10 may be cast of steel in the same shape as shown in the drawing. The body 10 may also be cast of manganese bronze to deter cutting by means of a oxi-acetylene torch. The body 10 may be crimped into the shape shown as a double back structure known to those skilled in the art to produce a unitary structure without welding by the progressive stamping process. Where appropriate, the finished structure 10 may be heat treated for increased resistance to cutting or shearing.

Figure 2:
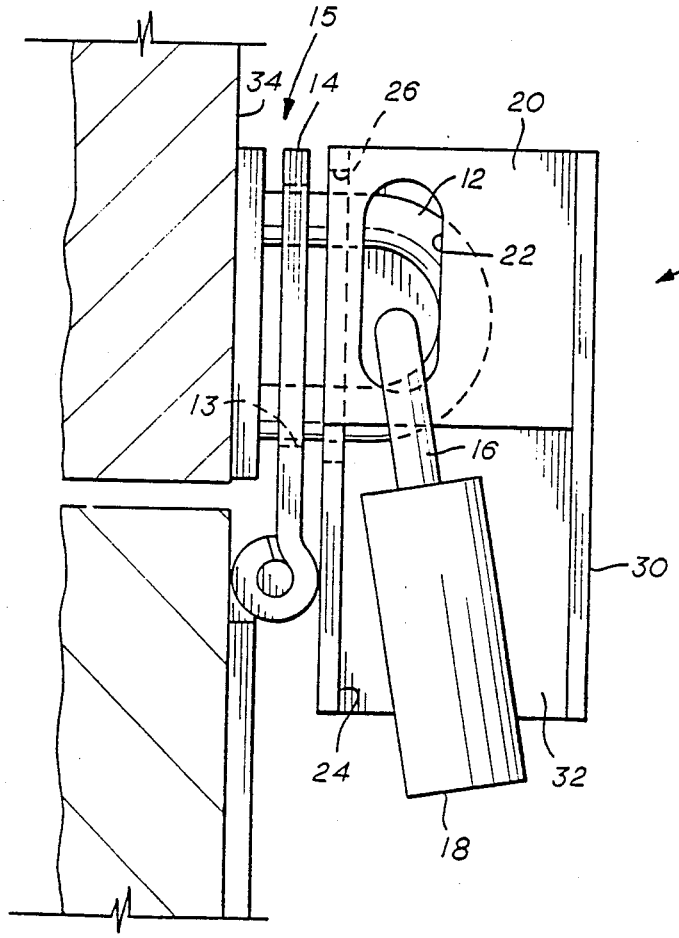
FIG. 2 is a side view of the lock protection device taken along the line 2—2 of FIG. 1.
Figure 3:
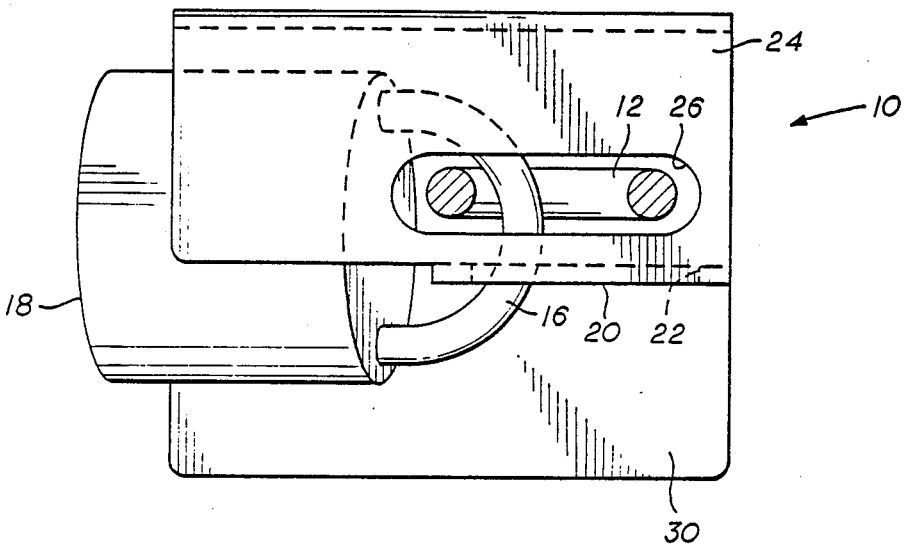
FIG. 3 is another side view of the lock protection device as taken along the line 3—3 of FIG. 1.
Figure 4:
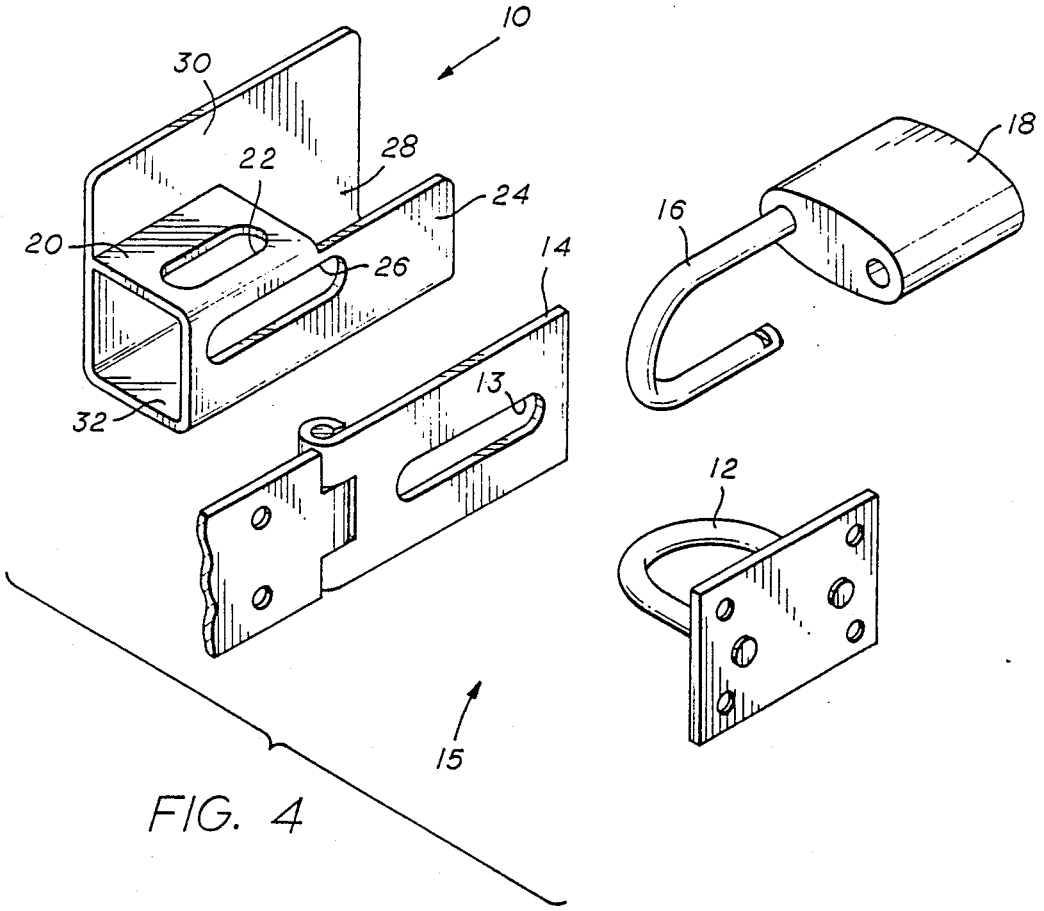
FIG. 4 is a perspective exploded view of the lock protection device, the slotted strap of a hasp, the staple of a hasp, and a padlock prior to their assembly into the structure shown in FIGS. 1–3.

The slot 26 is formed such that the staple loop 12 can pass through the slot 13 and through the slot 26 as a prelude to locking the hasp 15. The unlocked shackle 16 of the padlock 18 is then fitted through the slot 22 and also through the staple loop 12 as shown in FIGS. 1–3 to enclose a portion of the side 20 and the staple 12 within the confines of the shackle 16.

As the shackle is locked into the padlock 18, the padlock has been positioned up within the skirts of sides 24, 28, and 32 and is additionally protected by the flange 30. The hasp 15 is desirably installed such that the space between the shield flange 20 and the base 34 to which the staple 12 is attached is very small, a space too small for a tool such as a bolt cutter to be inserted.

A commercial embodiment of the device, as illustrated and described, can be made of a single piece of 3/16 inch rectangular metal plate or sheet which is progressively stamped at 90 degree angles to form three longitudinal sides in the process known generally as progressive stamping. Each side of sides 24, 28, and 32 is of equal depth and include the flange 30. The remaining side 20 is then shaped and welded into position as shown to form the unitary body 10.

The shackle 16 thus jointly retains and locks the staple 12 of the hasp 15 and the protective device 10 together while protecting the lock shackle 16 and the staple loop 12 against disablement from cutters.

Figure 5:
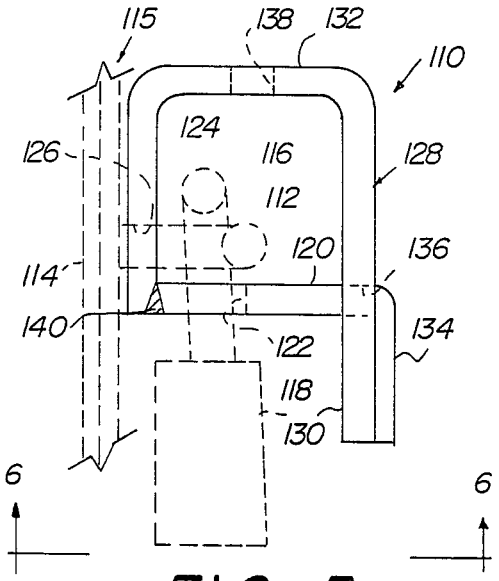
FIG. 5 is a side view of another embodiment of the device shown in FIG. 1.
Figure 6:
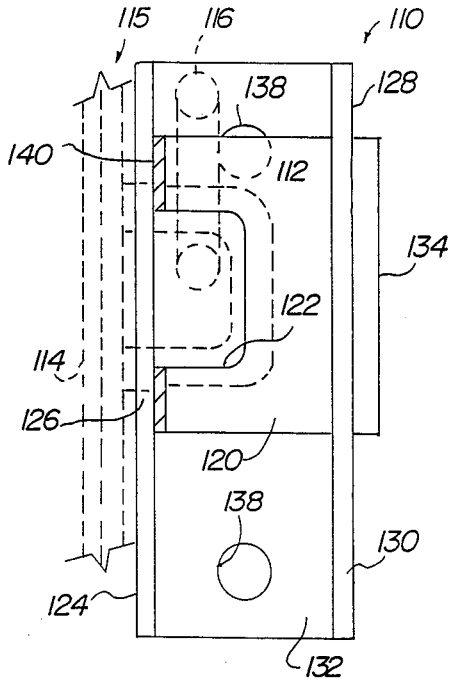
FIG. 6 is a view of the device of FIG. 5 as taken along the line 6—6 of FIG. 5.

A alternate embodiment is illustrated in FIGS. 5 and 6. Like elements of the elements in FIGS. 1 and 2 bear the same numbers with a prefix "1".

As shown, the body 110 forms an enclosure which is generally rectangular in cross-section including a side 120 forming a shackle slot 122, and a skirted shield side 124 forming a hasp staple slot 126 and a skirted shield side 128, all forming a shield flange 130. The shield sides 124 and 128 are joined together by a skirted shield side 132 to complete the rectangular enclosure of metal sheet as shown.

The side 120 extends part way along the skirts of the shield sides 124 and 128 such that the shackle 116 of the lock 118 may be inserted through the shackle slot 122 with the body of the padlock 118 substantially totally enclosed by the skirts of the shield sides 124, 128, and 132. As noted, the body 110 is an integral body with all the sides 120, 124, 128 and 132 being a unitary structure.

It is noted that any of the body sides 20, 24, 28 and 32 in FIGS. 1 and 2, and the like sides 120, 124, 128 and 132 of FIGS. 5 and 6 all may have welded joints if desired. Alternately, and where practicable, such joints may be formed during progressive stamping operations.

In FIGS. 5 and 6 the joints between the sides 124, 132 and 128 may be formed by progressive stamping. The holes 138 serve only as alignment holes for alignment pins within a stamping die. The joint between the side 120 and side extension 134 may also be stamped as shown. The side 120 may then be inserted through a slot 136 formed in side 128 and joined to side 124 by typical weld 140 as shown.

Units of the device 10 have been manufactured as shown in FIGS. 5 and 6 through the following steps. A flat rectangular piece of metal, plate or sheet which will become sides 124, 132, 128 and 130 is first cut to size as by shearing. The slotted openings 126 and 136 are formed as by punching. The alignment holes 138 are formed by drilling or punching. This first piece is then placed in a stamping die with alignment pins (not shown) are placed through holes 138 to align the piece in the die. The first piece is then stamped to form the walls 124, 132, 128 and 130 as shown.

A second piece is cut to size for forming walls 120, wall extension 134 and the opening 122 is punched. This second piece is then stamped to form the walls 120 and extension 134 as shown. The wall 20 is next inserted through the slot 136 into abutment with the wall 124 and welded with the typical welds 140. It is possible, if desired, for the slot 136 and the extension 134 to be deleted and the side 120 then welded to both the side 124 and side 128 as typically shown by weld 140.

It is possible for the sides 20 and 24 as shown in FIG. 1 to be formed by stamping. However, shackle slot 22 and the hasp staple slot 26 are then best formed as by flame cutting or milling after the stamping step since the flat piece of plate is not suitable for stamping between these slots if previously formed. embodiment illustrated and described herein may be modified to a considerable extent and remain within the spirit of the invention and purview of the appended claims.

That being claimed is:

1. A metal access prevention device, comprising:

(a) a first wall member having a hasp staple loop opening through its sidewalls;

(b) a second wall member having a loop shackle loop formed by a shackle opening through its sidewalls and by the lower edge of said second wall member;

(c) a third wall member and a fourth wall member joined together and joined to said first wall member and said second wall member to form a rectangular shape;

(d) said hasp staple loop opening and said lock shackle opening being disposed and arranged to permit a shape staple loop to be extended through said hasp staple loop opening and the shackle of a lock to be extended through said hasp staple loop and through said lock shackle loop before locking said shackle to said lock; and (e) whereby said hasp staple loop, said shackle, and said lock shackle loop are interlinked and locked together.

2. The device of claim 1 wherein said first wall member, said third wall member and said fourth wall member are respectively extended to protect said lock.

3. The device of claim 2 wherein said second wall is fitted and connected between said first wall and said third wall to form said rectangular shape.

4. The device of claim 3 wherein said hasp staple loop opening and said shackle opening are punched openings.

* * * * *